US005809894A

United States Patent [19]

Goldstein

[11] Patent Number: 5,809,894

[45] Date of Patent: Sep. 22, 1998

[54] SYSTEM AND METHOD FOR REGISTRATION CONTROL ON-PRESS DURING PRESS SET-UP AND PRINTING

[75] Inventor: Michael D. Goldstein, Herzlia, Israel

[73] Assignee: Advanced Vision Technology, Ltd., Herzelia, Israel

[21] Appl. No.: 801,400

[22] Filed: Feb. 20, 1997

[51] Int. Cl.[6] ..... B41M 1/12

[52] U.S. Cl. ..... 101/486; 101/18.1; 101/211; 101/DIG. 36; 364/471.01; 347/260

[58] Field of Search ..... 101/181, 211, 101/DIG. 36, 485, 486; 364/471.01, 469.03, 469.04; 347/260; 354/115

[56] References Cited

U.S. PATENT DOCUMENTS

| | | | |
|---|---|---|---|
| 4,932,320 | 6/1990 | Brunetti et al. | 101/211 |
| 5,056,430 | 10/1991 | Bayerlein et al. | 101/211 |
| 5,063,528 | 11/1991 | Miwa et al. | 101/211 |
| 5,068,810 | 11/1991 | Ott | 101/211 |
| 5,539,487 | 7/1996 | Taguchi et al. | 354/115 |
| 5,572,433 | 11/1996 | Falconer | 364/471.01 |
| 5,592,211 | 1/1997 | Porter et al. | 347/260 |
| 5,633,676 | 5/1997 | Harley et al. | 101/DIG. 36 |

OTHER PUBLICATIONS

Book: Ernest L. Hall, *Computer Image Processing and Recognition*, pp. 231–238 (1979).

Book: William H. Press, et al., *Numerical Recipes in C, The Art of Scientific Computing, Second Edition*, pp. 564–568.

*Primary Examiner*—Eugene H. Eickholt

*Attorney, Agent, or Firm*—Wilson Sonsini Goodrich & Rosati

[57] ABSTRACT

A system and method for controlling registration between different printing plates or printing cylinders in a printing press which includes a camera with a lens having at least two zoom settings and a control unit for changing the zoom setting of the camera in accordance with a distance between registration marks printed on a printed substrate found in at least one image acquired by the camera.

20 Claims, 3 Drawing Sheets

SYSTEM AND METHOD FOR REGISTRATION CONTROL ON-PRESS DURING PRESS SET-UP AND PRINTING

FIELD OF THE INVENTION

The present invention relates to a system and method for registration control on press during printing press set up and printing generally and more particularly to on-press registration control during press set-up and printing using variable zoom.

BACKGROUND OF THE INVENTION

One of the major factors governing the quality of a printed image printed on a printing substrate by a printing press is registration. When printing plates or printing cylinders are in registration they are accurately positioned with respect to each other during printing providing exact overlap between different printed colors. Otherwise the plates or cylinders are not in registration which results in deficient printing quality of the printed image.

Generally speaking, two types of registration control systems are known in the art, namely mechanical and electronic.

In a mechanical registration control system, a sample printed image is inspected by an operator during press set-up, the operator enters correction instructions to the press according to the extent of misregistration.

In electronic systems for controlling registration, an image of registration marks is taken during press set-up and correction instructions are provided to the press based on the analysis performed by the electronic system.

SUMMARY OF THE INVENTION

An object of the present invention is to provide an improved registration control system operative during press set-up and during printing.

Yet another object of the present invention is to provide a registration control system which is operative in variable resolution in accordance with the distance between the registration marks.

There is thus provided, in accordance with a preferred embodiment of the present invention, a system for controlling registration between different printing plates or printing cylinders in a printing press which includes a camera, preferably a CCD camera, including a lens having at least two zoom settings and a control unit for changing the zoom setting of said camera in accordance with a distance between registration marks printed on said printed substrate found in at least one image acquired by said camera. In a preferred embodiment of the present invention, the distance is calculated from the internal maximal distance (IMD) between said registration marks.

In accordance with a preferred embodiment of the present invention, the camera is set in a first zoom-out setting and the control unit is operative to zoom-in said zoom setting in accordance with decrease in said distance control unit is also operative to set said camera in a zoom-out setting in case of fault, such as splice, in the press operation.

Further, according to a preferred embodiment, the control unit is operative to determine the distance in accordance with previously determined distances between said registration marks. In one preferred embodiment the distance is determined employing linear prediction.

The system of the present invention may also include a color measurement device. In a preferred embodiment, the color measurement device is operative in conjunction with said camera.

There is also provided, in accordance with a preferred embodiment of the present invention a method for controlling registration on press during press set-up and printing which includes the following steps:

a. acquiring a first image in a first resolution of registration marks printed by said press on a printing substrate, said registration marks in a first registration relationship;

b. correcting misregistration between printing plates or printing cylinders mounted on said press in accordance with a distance between said registration marks, whereby said registration marks are in a second registration relationship;

c. acquiring, for example by a CCD camera, a second image in said first resolution of said registration marks in said second registration relationship;

d. comparing said distance between said registration marks in said first registration relationship and said second registration relationship; and e. determining whether to increase the resolution of said acquiring of said first image and the acquiring of said second image in accordance with the results of said comparison whereby images in a second resolution are acquired.

In a preferred embodiment, the distance is calculated from the internal maximal distance between said registration marks which may also be derived employing linear prediction.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figures 1, 2A, 2B:
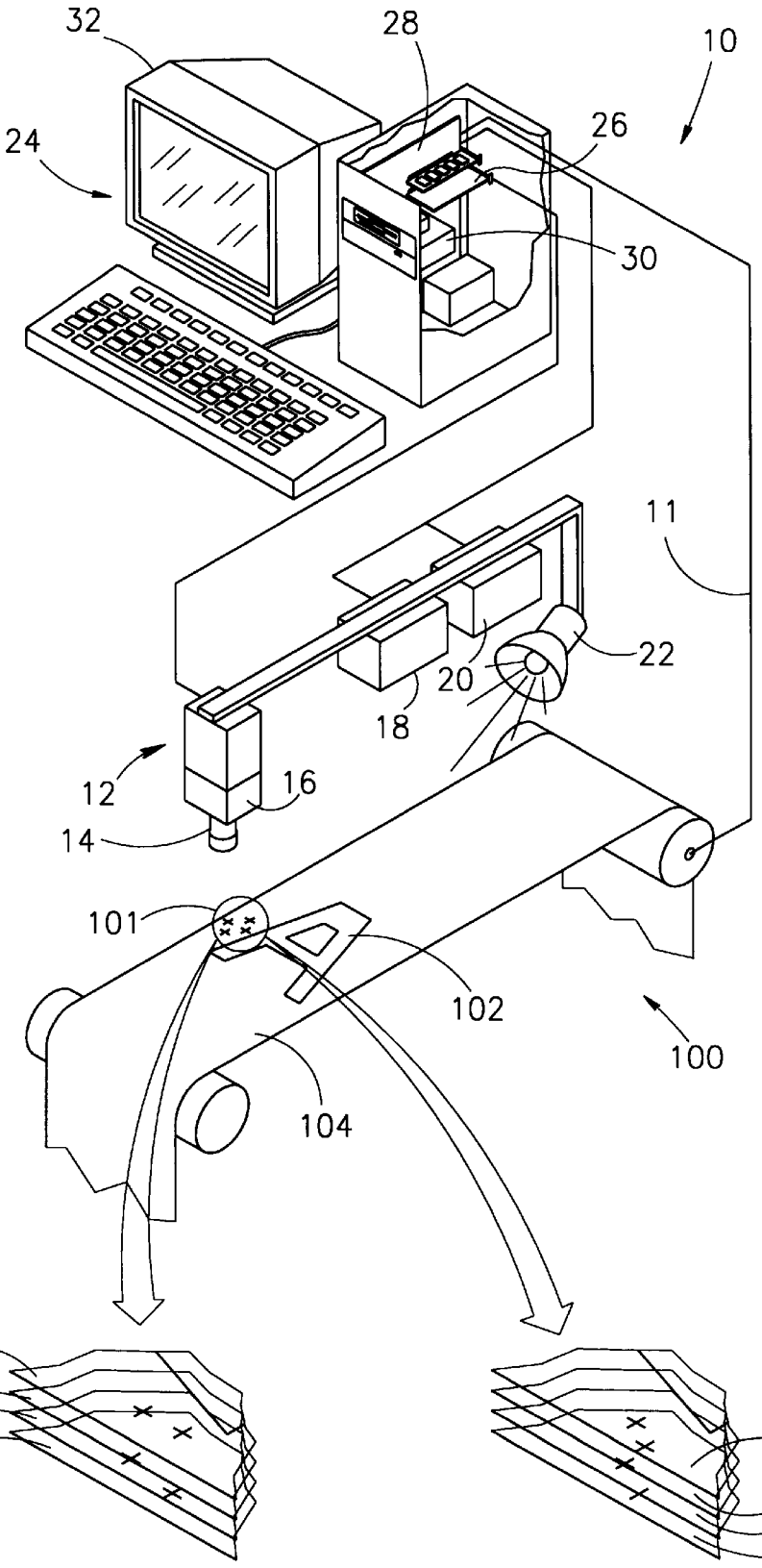
FIG. 1 is a schematic pictorial illustration of a registration control system, constructed and operative in accordance with a preferred embodiment of the present invention.
FIGS. 2A and 2B are schematic pictorial illustrations of the distance between registration marks on four different printing plates representing the four process colors CMYK (Cyan, Magenta, Yellow, and Black) during press set up and printing, respectively.

Reference is now made to FIG. 1 which illustrates a registration control system, generally referenced 10, constructed and operative in accordance with a preferred embodiment of the present invention. Registration control system 10 is operative to determine the distance between registration marks 101 during press set-up and during printing of printing press 100 and to change the resolution of the measurement in accordance therewith.

In a preferred embodiment the system operates to increase the resolution of the measurement as the distance between registration marks 101 decreases.

Registration control system 10 is preferably connected to a printing press so as to synchronize therewith and to provide registration control instructions thereto as indicated by reference numeral 11. Printing press 100 may be any printing press known in the art. It may be a conventional press, such as lithographic, gravure or flexo printing press or a digital printing press, such as a digital offset press. Also it may be a web printing press as schematically illustrated in FIG. 1 or a sheet fed printing press.

Registration control system 10 comprises a camera 12, such as a video camera, having a variable zoom lens 14 coupled to a zoom control unit 16, such as a servomotor, and a light source 22. Registration control system 10 also comprises a processing and control unit 24 which includes an image buffer 26, a CPU 28, a memory 30, such as a hard disk and a monitor 32.

Camera 12 may be any suitable camera which captures images, such as the DXC-930 manufactured and sold by Sony of Japan. In a preferred embodiment, video camera 12 includes a two-dimensional color CCD operative to capture images in a Red, Green, Blue (RGB) color space. Alternatively, it may be based on a linear CCD array and/or may be operative in black and white or in any other suitable color space, such as Cyan, Magenta, Yellow & Black (CMYK) color space or XYZ color space.

Zoom control unit 16 is operative to receive control commands from processing and control unit 24 and to zoom-in or zoom-out lens 14 in accordance therewith.

Light source 22 may be any suitable light source, such as N-108, commercially available from Drello GmbH of Munchengladbach, Germany. In the preferred embodiment, light source 22 is operative to provide flashes of light during image acquisition by camera 12.

As a non limiting example, processing and control unit 24 is illustrated in FIG. 1 as a computer, such as an International Business Machine (IBM) compatible personal computer having a CPU, such as an Intel Penthium Pro, a hard disk, a video card and a monitor.

In operation, processing and control unit 24 employs camera 12 to acquire images of registration marks 101 printed with a printed image 102 on printed substrate 104. Unit 24 determines the internal maximal distance (IMD) between the registration marks and provides control commands, i.e. whether to zoom-in or to zoom-out lens 14 in addition to other optical commands such as focusing, iris and shutter control.

Specifically, during press set-up registration is usually deficient therefore the distance between registration marks on different printing plates is large as illustrated in FIG. 2A. Therefore, a large field of view (FOV) is required and camera 12 is set to its zoom-out setting.

During press set up registration is corrected, therefore with the progression of press set-up and during actual printing the distance between registration marks 101 decreases as illustrated in FIG. 2B. Therefore, a small FOV is required and camera 12 is set in increasing zoom-in settings.

During splice, i.e. printed substrate change over in a continuous web printing press, registration is usually lost and camera 12 is set again in a zoom-out setting and the measurement and correction process is repeated.

Preferably, but not necessarily, camera 12 with zoom control unit 16 and light source 22 coupled thereto form part of a location system. The location system is preferably a visual based location system which operates in two modes, interactively and automatically. In the interactive mode, the press operator interactively selects the area in which the registration marks are printed. In the automatic mode, the location system determines the area in which an image of the registration marks is to be acquired automatically. A suitable location system operative in these two modes of operation is the Print Vision-9000™ automatic press inspection system, commercially available from Advanced Vision Technologies (AVT) Ltd. of Herzlia, Israel.

It will be appreciated that according to the present invention, the location system provides the area of the acquired image of the registration marks whereas the image enables the determination of the resolution of the next measurement in a reference coordinate system.

It will further be appreciated that the reference coordinate system in which the acquired image is represented may be any suitable coordinate system. In a preferred embodiment, the press and the registration control system are synchronized and use the same coordinate system to indicate absolute positions in a cartesian coordinate system.

Figure 3:
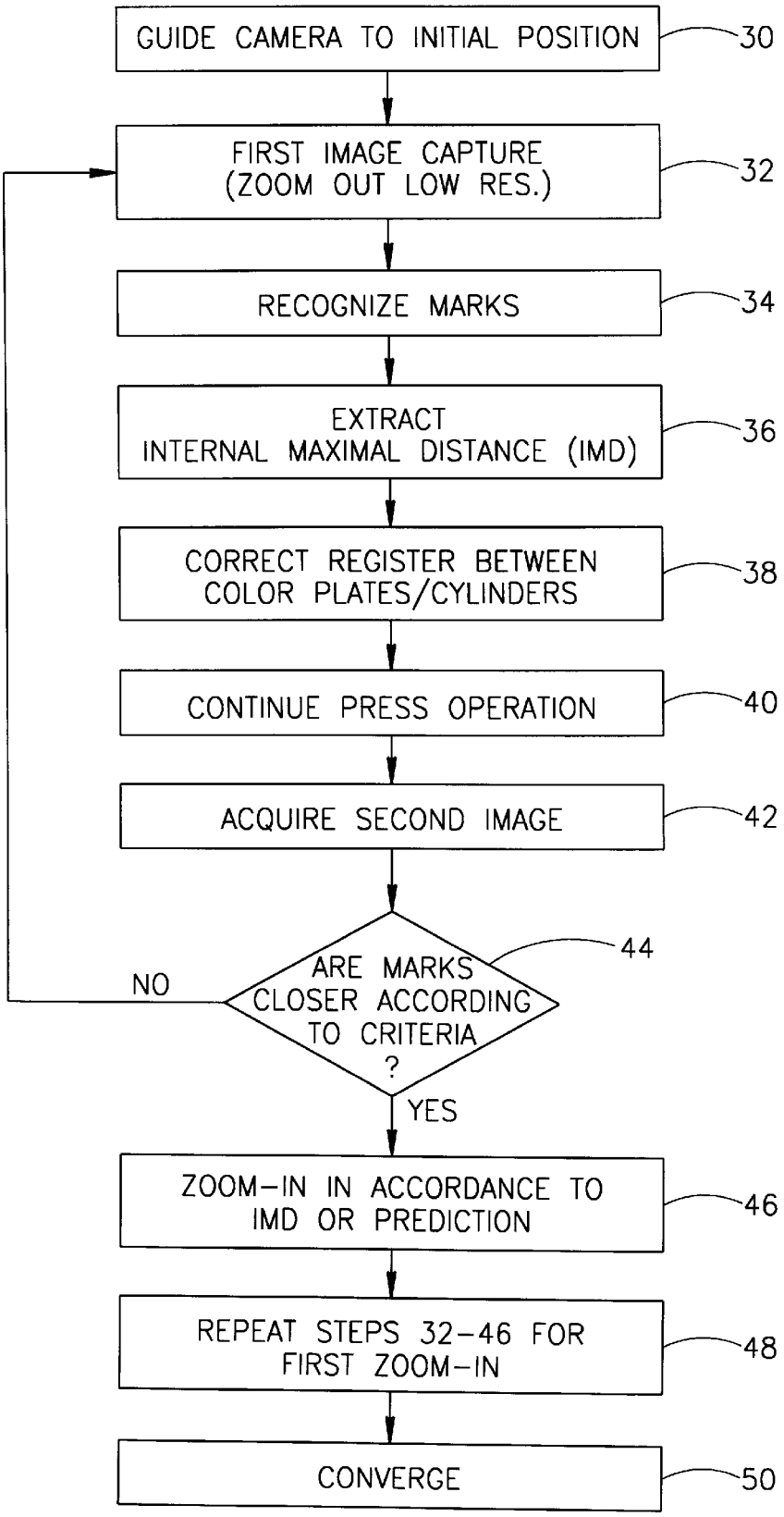
FIG. 3 is a schematic block diagram illustration of a preferred method for operating the registration control system of FIG. 1.

Referring now to FIG. 3, a preferred method for operating the registration control system 10 is illustrated. The method of FIG. 3 starts with an initial location of the camera (step 30) using the Print Vision 9000™ system. In a preferred embodiment, the initial position of the camera can be also set manually by the operator or can be determined in accordance with a digital file prepared during the pre-press production of the files representing the printing plates and including the registration marks.

In another embodiment, the digital file representing the printing plates is loaded into the computer. The process continues with a first image capture indicated by step 32. Lens 14 is in a zoom-out setting thus provides a large FOV and a low resolution image. In step 34 registration marks are recognized. In step 36 unit 24 extracts the internal maximal distance (IMD) which is the maximal distance between any of the registration marks captured in the image. In step 38 registration correction control commands are provided to press 100 or correction instructions are displayed on display 32 allowing the operator to manually correct the registration between the printing plates or cylinders. The press operation continues at 40. Then, in step 42 a second image at same zoom-out setting is acquired.

In step 44, unit 24 determines whether the registration marks are closer to each other so as to zoom-in lens 14 as indicated by step 46 so as to repeat steps 32–44 in a higher resolution as indicated by 48 until convergence of the marks is achieved as indicated by step 50 and the plates or cylinders are in registration.

According to one preferred embodiment, step 44 includes the step of comparing the IMD between the registration marks in the first and second images. In accordance with another preferred embodiment, described with reference to FIG. 5 hereinbelow, a predictive method is used for a similar purpose.

According to a preferred embodiment, steps 32–46 are repeated for a number of zoom settings providing progressively higher resolution so as to provide accurate distance measurements between the registration marks 101.

Figure 4:
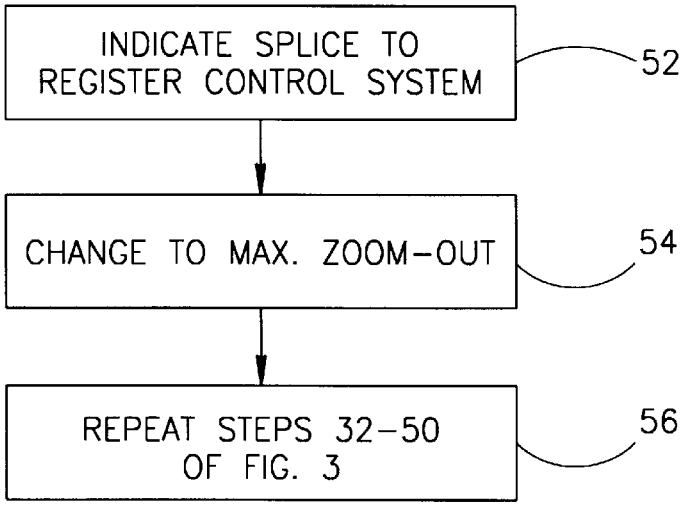
FIG. 4 is a schematic block diagram illustration of the method of FIG. 3 for the case of splice (real printing substrate roll change-over)

FIG. 4 illustrates the operation of system 10 during splice. While the illustrated embodiment refers to splice, it will be appreciated by persons skilled in the art that it is similarly applicable to any major operation fault of press 100. In case of splice indicated by 52, registration is lost due to the real change over of printing roll. As indicated by step 54, lens 14 setting is changed to zoom-out setting either by the operator or automatically and the steps 32–50 of FIG. 3 are repeated as indicated by 56.

Figure 5:
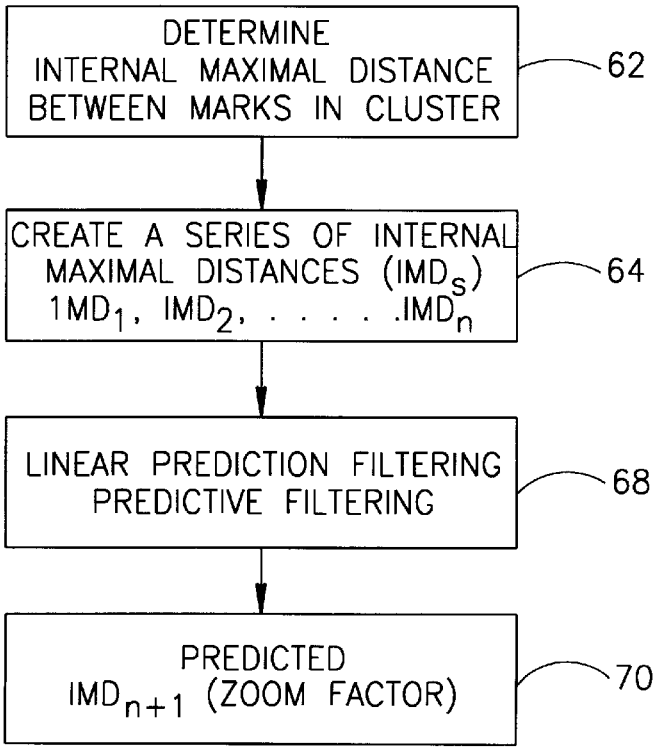
FIG. 5 is a schematic block diagram illustration of a preferred method for the step of analyzing the distance between registration marks in FIG. 3.

FIG. 5 illustrates a preferred embodiment of step 46 (FIG. 3). In the method of FIG. 5, a prediction as to the next zoom setting is provided using a linear prediction algorithm. In step 62, a first IMD corresponding to the first image acquired is extracted and stored. In step 64, a series of IMD values, namely IMD1, IMD2 . . . IMDn is determined and fed to CPU 28 which executes a linear prediction model so as to predict the next IMD, namely IMDn+1 as indicated by 70 so as to set the zoom setting of camera 12 accordingly.

A suitable linear prediction model to be executed by CPU 28 is the one described in pages 564–568 of the book entitled Numerical Recipes in C by William H. Press et al., published by Cambridge University Press in 1992 the content of which is incorporated herein by reference.

It will be appreciated that the preferred embodiments described hereinabove are described by way of example only and that numerous modifications thereto, all of which fall within the scope of the present invention, exist. For example, referring again to FIG. 1 there are shown color measurement devices 18 and 20 which represent any number of color measurement devices. Color measurement devices 18 and 20 may be employed in conjunction with registration control system 10 to provide both registration control and color control of press 100. The operation of color control units 18 and 20 is described in co-invented co-assigned U.S. patent application Ser. No. 08/624,886 filed Mar. 27, 1996 incorporated herein by reference.

It will also be appreciated by persons skilled in the art that while the preferred embodiments hereinabove have been described with respect to printing plates, i.e., with respect to offset printing, the present invention is equally applicable to printing cylinders and aggressive printing press or to flexo printing.

It will be further appreciated by persons skilled in the art that the present invention is not limited by what has been particularly shown and described herein above. Rather the scope of the invention is defined by the claims which follow:

I claim:

1. A system for controlling registration of marks printed on a substrate passing between different printing plates or printing cylinders in a printing press comprising:

a camera including a lens having at least two zoom settings; and a control unit for changing the zoom setting of said camera in accordance with a distance between registration marks printed on a printed substrate found in at least one image acquired by said camera.

2. A system according to claim 1 wherein said camera is a CCD camera.

3. A system according to claim 1 wherein said distance is calculated from the internal maximal distance between said registration marks.

4. A system according to claim 1 wherein said camera is set in a first zoom-out setting and wherein said control unit is operative to zoom-in said zoom setting in accordance with decrease in said distance between said registration marks.

5. A system according to claim 1 wherein said control unit is also operative to set said camera in a zoom-out setting in case of a fault in the press operation.

6. A system according to claim 5 wherein said fault is a splice.

7. A system according to claim 3 wherein said control unit is operative to determine said distance in accordance with previously determined distances between said registration marks.

8. A system according to claim 7 wherein said distance is determined employing linear prediction.

9. A system according to claim 1 also including a color measurement device.

10. A system according to claim 9 wherein said color measurement device is operative in conjunction with said camera.

11. A method for controlling registration on press during press set-up and printing comprising:

acquiring a first image in a first resolution of registration marks printed by said press on a printing substrate, said registration marks in a first registration relationship;

correcting misregistration between printing plates or printing cylinders mounted on said press in accordance with a distance between said registration marks, whereby said registration marks are in a second registration relationship;

acquiring a second image in said first resolution of said registration marks in said second registration relationship;

comparing said distance between said registration marks in said first registration relationship and said second registration relationship; and determining whether to increase the resolution of said acquiring of said first image and the acquiring of said second image in accordance with the results of said comparison whereby images in a second resolution are acquired.

12. A method according to claim 11 wherein said acquiring includes acquiring by a camera.

13. A method according to claim 11 wherein said distance is calculated from the internal maximal distance between said registration marks.

14. A method according to claim 12 wherein said camera is set in a first zoom-out setting and including control unit operative to zoom-in said zoom setting in accordance with a decrease in said distance, thereby providing said images in said second resolution.

15. A method according to claim 11 wherein said camera is operative to acquire images in said first resolution in case of fault in said press operation.

16. A method according to claim 15 wherein said fault is a splice.

17. A method according to claim 14 wherein said control unit is operative to determine said distance in accordance with previously determined distances between said registration marks.

18. A method according to claim 12 wherein said distance is calculated by linear prediction.

19. A method according to claim 12 also including operating a color measurements device.

20. A method according to claim 19 including operating said color measurements device in conjunction with said camera.

* * * * *